US005954376A

United States Patent [19]

Ader

[11] Patent Number: 5,954,376

[45] Date of Patent: Sep. 21, 1999

[54] GOLF BALL RETRIEVER

[76] Inventor: Vern L. Ader, 2988 Gruenwald Rd., Mosinee, Wis. 54455

[21] Appl. No.: 09/008,975

[22] Filed: Jan. 20, 1998

[51] Int. Cl.[6] ..... A63B 47/02

[52] U.S. Cl. ..... 294/19.2; 294/66.1

[58] Field of Search ..... 294/19.1, 19.2, 294/55, 66.1; 37/316; 56/400.01, 400.04, 400.11, 400.12, 400.17, 328.1

[56] References Cited

U.S. PATENT DOCUMENTS

| | | | |
|---|---|---|---|
| 3,276,807 | 10/1966 | Ward | 294/19.2 X |
| 5,110,168 | 5/1992 | Petrillo | 294/19.2 |
| 5,137,315 | 8/1992 | Bontempo | 294/19.2 |
| 5,303,967 | 4/1994 | Dufow | 294/19.2 |
| 5,328,220 | 7/1994 | McPherson | 294/19.2 |
| 5,368,350 | 11/1994 | Ader et al. | 294/19.2 |
| 5,511,841 | 4/1996 | Allen | 294/19.2 X |
| 5,651,571 | 7/1997 | Diveto | 294/19.2 |
| 5,662,366 | 9/1997 | Fraske | 294/19.2 |

*Primary Examiner*—Johnny D. Cherry

[57] ABSTRACT

An improved multiple purpose golf ball retriever for retrieving golf balls from water hazards. The device comprises an elongated head which has a forward frame, rear frame, upper frame and side frames. The elongated head's handle mount can be permanently attached to a telescoping handle. The telescoping handle is attached to the handle mount on the upper frame offset from its center at a compound angle which aids capturing the ball in the raking mode while also facilitating the use of a wood or putter cover and ease of storage in the golf bag. The side frames inside diameters are slightly smaller than a golf ball which enables the golf ball retriever to capture the ball by going down over the ball from either side at any angle. The retriever can be used as a rake in clear or blind locations and from either side at any angle for clear water or rocky weedy and hazardous water areas that restrict the raking action.

1 Claim, 2 Drawing Sheets

Section I - I

GOLF BALL RETRIEVER

BACKGROUND

1. Field of the Invention

This invention relates to golf ball retrievers, specifically to an improved mechanism for retrieving golf balls from water hazards.

2. Description of Prior Art

The prior art has various devices for scooping or raking a golf ball from a water hazard or other inaccessible areas. Recent prior art has raking devices to retrieve the ball when the operator is unable to see the ball. U.S. Pat. Nos. 5,110,168 to Petrillo, (1992), 5,303,967, to Dubow (1994), 5, 368,350 to Ader-Dohn, (1994). 5,511,841 to Allen, (1996), 5,651,571, to Diveto, (1997) and 5.662,366 to Fraske, (1997). All of these retrieving devices rake or scoop the ball in clear or blind water areas and capture the ball to be retrieved. Although these golf ball retrievers are capable of entrapping the golf ball in many hazards, they are all limited to a single purpose raking or dipping action to retrieve the golf ball. Also all of the previous retrievers have cumbersome methods of attaching the retriever head to the telescoping handle so that the retriever head can be protected with a cover that can be easily and quickly slipped on and off the retriever head. The cover is necessary to protect the other clubs in the golf bag as well as the retriever head. Folding retriever heads are inconvenient and slow play on the golf course. The other raking heads are T shaped which makes it difficult to attach a cover and also to fit conveniently in the golf bag.

OBJECTS AND ADVANTAGES

Accordingly, several objects and advantages of the present invention are:

(a) To provide a multi-purpose golf ball retriever to which the elongated head part can be permanently attached to the telescoping handle, that easily accepts a protective cover that slips on and off with ease, that fits in the golf bag conveniently with the other clubs and is readily accessible for instant retrieving when needed.

(b) To provide a golf ball retiever which has a multilple purpose retriever head which can capture the ball by visual or blind raking and also retrieve the ball from either end at any angle from water or other hazardous locations.

further objects and advantages are to provide a golf ball retriever which is simple, convenient to use, inexpensive to manufacture, durable and which can be easily mounted on the telescoping handle. Still further objects and advantages will become apparent from a consideration of the ensuing description and drawings.

DRAWING FIGURES

In the Drawings

REFERENCE NUMERALS IN DRAWINGS

| | |
|---|---|
| 10 head | 12 forward frame |
| 14 rear frame | 16 upper frame |
| 18 side frame | 20 handle mount |
| 22 handle fastening device | 24 telescoping handle |
| 26 ball | |

Description—FIGS. 1 to 4

Figure 1:
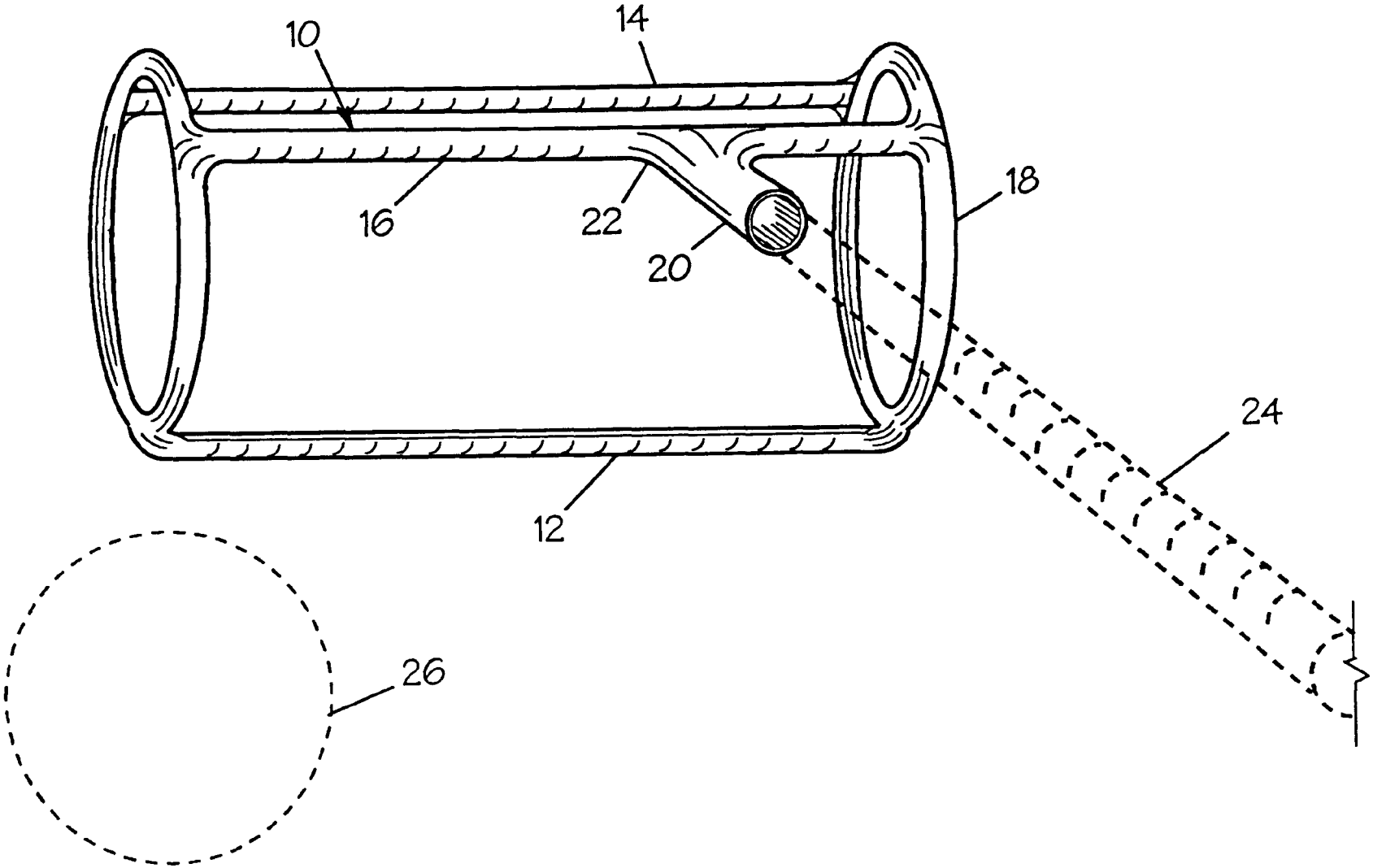
FIG. 1 is a perspective view of an elongated head part of the retriever according to the invention.

FIG. 1 shows a perspective view of a typical embodiment of a head part 10 of the present invention. The head part 10 has an elongate shape and includes a forward frame part 12, a rear frame part 14, an upper frame part 16, side frame parts 18, and a handle mount part 20. The forward frame part 12, the rear frame part 14 and the upper frame part 16 are fastened to the side frame parts 18. The space between the forward frame part 12 to the upper frame part 16 is larger than the diameter of a golf ball to permit entry of the golf ball 26. The forward frame part 12 to the rear frame part 14 and rear frame part 14 to top frame part 16 distances are less than the diameter of a golf ball to secure the ball 26 after it is retrieved.

Figure 2:
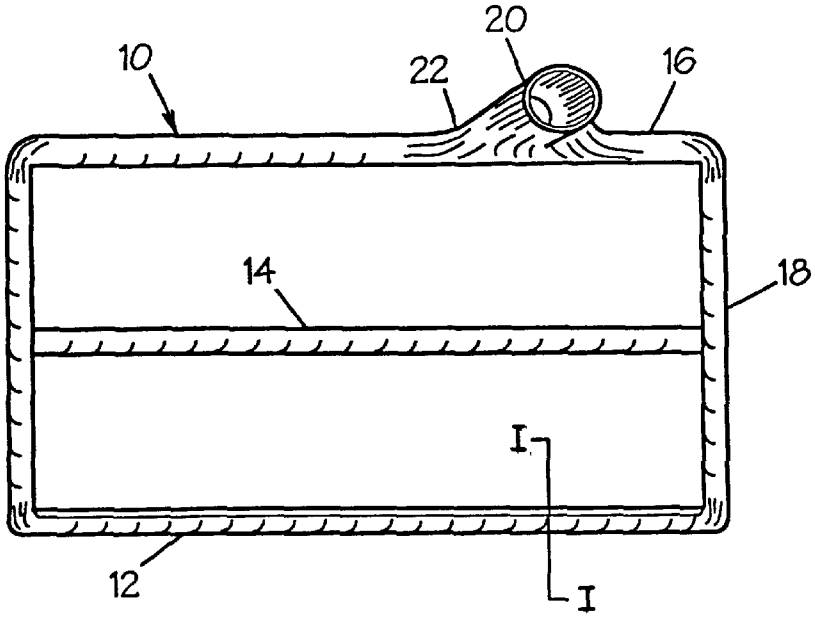
FIG. 2 is a front view of the golf ball retriever showing the forward, rear and upper frames, the side frames and the off center angled handle mount.

FIG. 2. As shown the side frame part 18 are fastened to the forward frame part 12, the rear frame part 14 and the top frame part 16. The off center handle mount part 20 is fastened to the top frame part 16 at an compound angle to facilitate pulling a golf ball retriever cover over the head part 10. The off center angled handle mount part 20 is fastened to the upper frame part 16. which aids in viewing and retrieving the golf ball part 26.

Figure 3:
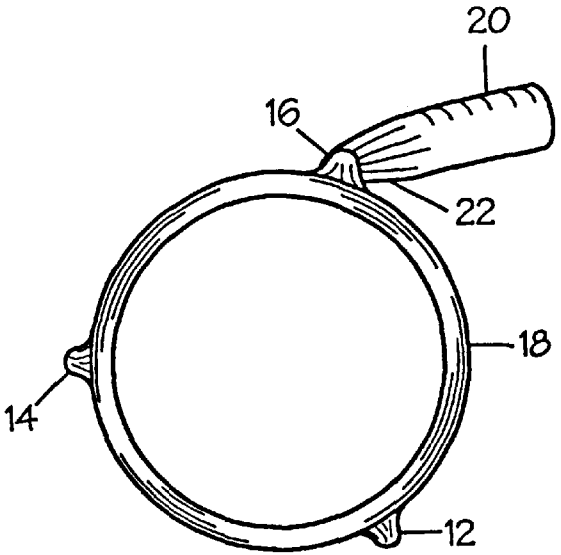
FIG. 3 is an end view of the head part of FIG. 1 showing the the side frames that capture the golf ball, the position of the front, rear and top frames and the handle mount at a second compound angle.

FIG. 3. shows the side frame parts 18 and their attachment to the forward frame part 12, the rear frame part 14, the top frame part 16 and the handle mount part 20. The inside diameters of the side frame parts 18 are slightly less than the diameter of a golf ball part 26 which enables the golf ball to be retrieved when the side frame parts 18 are pressed against the golf ball part 26 from any angle. FIG 3. also shows the angled attachment of the handle mount part 20 to the upper frame part 16. When retrieving the golf ball part 26 by raking, this angle provides the correct position for the forward frame part 12 to drag on the bottom surface area.

Figure 4:
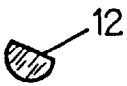
FIG. 4 is a end view of the forward frame with an optional lead angle.

FIG. 4. shows that the forward frame part 12 can be shaped at an angle to facilitate the golf ball entrance into the head 10.

Although the discription above contains many specifications, these should not be construed as limiting the scope of the invention but as merely providing illustrations of some of the presently preferred embodiments of this invention. For example, the side frame can be shaped in a square, triangle or any shape that will accomplish the purpose of retrieving a golf ball.

Thus, the scope of the invention should be determined by the appended claims and their legal equivalents, rather than the example given.

I claim:

1. A golf ball retriever comprising:

a) an elongate angled head for retrieving golf balls from a body of water, said head having a forward frame with a rear frame spaced therefrom to provide support for a retrieved golf ball;

b) the forward frame having a forward portion and an upper portion with the distance therebetween being wider than the diameter of a golf ball while the distance between the forward portion and the rear frame and the distance between the rear frame and upper frame portion are less than the diameter of a golf ball;

c) a pair of side frame means for connecting the forward portion, the rear frame and the upper portion, the side frame means having an inside diameter smaller than a golf ball to provide means to accept and retrieve a golf ball when the side frame means are pressed against the ball from any angle;

e) a means for fastening a handle to a fixed compound angled handle mount that provides ease of mounting and removing a head cover, storage in a golf bag, better visability and ball access into the retriever head;

f) whereby a golf ball is caused to enter the forward frame when the head is pulled against the golf ball, or, alternately, when one of the head side frame means is pushed against the ball, from any angle, the side frame means opening wedges the ball thereby trapping the golf ball;

e) the forward portion has an optional angled front to facilitate movement of the ball over the forward portion.

* * * * *